United States Patent [19]

Hynd

[11] 3,998,568

[45] Dec. 21, 1976

[54] PUMP-OFF CONTROL RESPONSIVE TO TIME CHANGES BETWEEN ROD STRING LOAD

[76] Inventor: Ike W. Hynd, P.O. Box 93, Midland, Tex. 79701

[22] Filed: May 27, 1975

[21] Appl. No.: 580,733

[52] U.S. Cl. ..... 417/12; 417/45; 417/53

[51] Int. Cl.[2] ..... F04B 49/00

[58] Field of Search ..... 318/474, 447; 417/12, 417/43, 53, 44, 45

[56] References Cited

UNITED STATES PATENTS

| | | | |
|---|---|---|---|
| 3,073,244 | 1/1963 | Elliot et al. | 417/43 |
| 3,075,466 | 1/1963 | Agnew et al. | 417/44 |
| 3,138,750 | 6/1964 | Borger et al. | 318/474 |
| 3,363,573 | 1/1968 | Jaeger | 417/12 |
| 3,413,535 | 11/1968 | Hubby | 318/447 |
| 3,440,512 | 4/1969 | Hubby | 318/474 |
| 3,509,824 | 5/1970 | Schmidly, Jr. | 417/12 |
| 3,778,694 | 12/1973 | Hubby | 417/44 |
| 3,851,995 | 12/1974 | Mills | 417/12 |
| 3,918,843 | 11/1975 | Douglas | 417/12 |
| R27,393 | 6/1972 | Aselman | 318/474 |

*Primary Examiner*—William L. Freeh
*Attorney, Agent, or Firm*—Marcus L. Bates

[57] ABSTRACT

A pump-off control unit for use in conjunction with a motor driven pumpjack assembly which is connected to reciprocate a downhole production pump. A current transformer connected to the pumpjack motor compares the time interval of a no-load portion of the pumping cycle to a second time interval, and shuts in the well when the ratio between the two intervals changes an amount which indicates a pump-off condition of the downhole pump assembly.

11 Claims, 5 Drawing Figures

PUMP-OFF CONTROL RESPONSIVE TO TIME CHANGES BETWEEN ROD STRING LOAD

BACKGROUND OF THE INVENTION

Most of the liquid producing oil wells which require artifical lift employ a motor drive pumpjack which reciprocates a string of sucker rods. The rods extend downhole several thousand feet to a production pump located in proximity of a production zone. As the motor drives the pumpjack apparatus, the sucker rod string causes the downhole pump to lift fluid to the surface of the earth. As the pumping action continues, the reservoir fluid level contained within the borehole annulus will usually be lowered until it recedes below the pump inlet, whereupon further pumping action induces an undesirable condition called "fluid pounding". Fluid pounding is caused by the pump piston accelerating in a downward direction through a gaseous phase, whereupon the piston encounters the liquid phase with sufficient force to produce a shock wave having a magnitude dependent upon the quantity of gaseous products ingested into the pump barrel. The shock wave causes damage to the entire production apparatus, and has been the subject of many different novel pump-off control means, as evidenced by the following patents, to which reference is made for further background of the invention.

| | |
|---|---|
| Mills | 3,851,995 |
| Schmidly Jr. | 3,509,824 |
| Elliot et al | 3,073,244 |
| Hubby | 3,413,535 |
| Hubby | 3,440,512 |
| Borger et al | 3,138,750 |
| Aselman Jr. | Re 27,393 |
| Jaeger | 3,363,573 |

Ideally, a pump-off control unit would directly measure the reservoir fluid level respective to the pump inlet, and control the pump in such a manner that the liquid level is always maintained above but in close proximity to the pump inlet, thereby realizing maximum production from the well while completely avoiding a pump-off condition. Since it is not feasible to measure a liquid level contained thousands of feet downhole in a borehole, it is therefore desirable to measure some variable associated with the production apparatus which changes in response to a change in reservoir fluid level. By utilizing this hypothetical variable for controlling the operation of the pumpjack apparatus, a severe pump-off condition can be avoided, while at the same time, a maximum production rate will be realized from the borehole.

SUMMARY OF THE INVENTION

A control device for de-energizing a prime mover upon encountering undesirable loads. In particular, the present invention relates to a control device for a prime mover which is subjected to a cyclic load normally varying between substantially repeated maximum and minimum values on successive cycles of operation wherein the time interval relationship of a maximum and minimum load value changes appreciably upon loss of load. The control apparatus has circuitry which generates a signal related to the time interval relationship of the maximum and minimum load value.

The signal will accordingly be representative of the time intervals of the high load value and the low load value. The low load value actuates a first time delay means which is set to time out at a value which slightly exceeds the value of the low load time under normal conditions of operation. When loss of load is experienced, the low load time interval increases and therefore enables the time delay to time out, whereupon a second time delay means is actuated.

The second time delay apparatus includes circuitry by which the signal causes it to time out concurrently with the motor encountering a high load time value. The last time delay relay therefore cannot time out unless a normal cyclic load condition is restored to the system.

Concurrently with the actuation of the last time delay means, there is further provided a time delay relay means connected to de-energize the prime mover after a plurality of loss of load cycles has transpired. If proper load conditions are restored to the motor, the second time delay means will time out and prevent the third time delay means from de-energizing the motor. On the other hand, if proper load conditions are not restored to the motor, the second time delay means will not time out; and therefore, the third time delay means will de-energize the motor.

A rest timer is further included for restoring the circuitry to normal operating conditions after a lapse of time during which the cause of the loss of load condition can be obviated.

The apparatus of the present invention preferably is used to control an electric motor of a pumpjack apparatus wherein a pump-off condition significantly changes the relationship between sequentially occurring no load and high load time intervals in a cyclic manner. When a pump-off condition is encountered, the low load time interval increases while the following high load time interval decreases, thereby providing a repeating pattern which signifies the condition of the downhole reservoir respective to the downhole pump.

Accordingly, a primary object of this invention is the provision of a pump-off control device which shuts in a pumpjack apparatus upon encountering a pump-off condition.

A further object of this invention is the provision of a controller which de-energizes a prime mover upon encountering undesirable loads thereon.

A further object of the present invention is the provision of a control device for use in conjunction with an electric motor of a pumpjack apparatus which shuts in the well upon encountering a pump-off condition, provides a rest period during which the downhole reservoir replenishes itself, and thereafter restarts the pumpjack apparatus until the downhole pump again becomes pumped off.

A still further object of the present invention is the provision of a control device which indirectly measures the strain on a polish rod by measuring current flow through an electric motor, and utilizes the cyclic change in the motor current for shutting in the well upon encountering a pump-off condition.

The above objects are attained in accordance with the present invention by the provision of circuitry made in accordance with the above abstract and summary.

DETAILED DESCRIPTION OF THE PREFERRED EMBODIMENT

Figure 1:
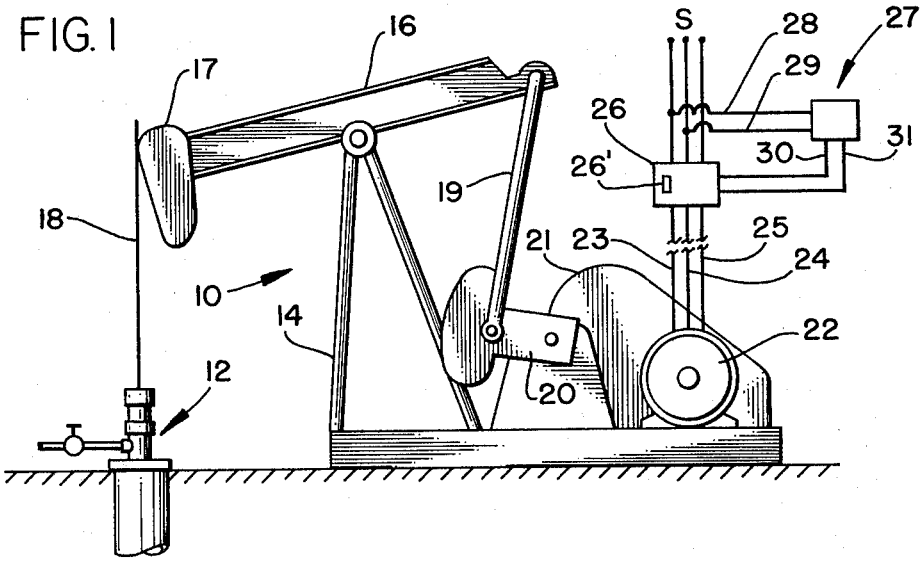
FIG. 1 is a part-diagrammatical, part-schematical representation of a side elevational view of a pumpjack apparatus operatively associated with a wellbore, and having a pump-off control device made in accordance with the present invention schematically illustrated in conjunction therewith.

In FIG. 1, the arrow at numeral 10 broadly illustrates one form of a pumpjack unit which can be used for producing a well. The arrow at numeral 12 generally illustrates a wellhead which forms the upper extremity of a cased borehole. The pumpjack unit includes the usual Sampson post 14, a walking beam 16, and a horsehead 17 which reciprocates a polish rod 18. The rod extends through the illustrated stuffing box, where it is connected to a string of sucker rod. The rod string extends downhole in axial alignment respective to the borehole for reciprocating a downhole production pump.

Connecting rod 19 is connected to crank 20, which in turn is driven by a gearbox 21. A three-phase, induction motor 22 is connected by electrical wires 23, 24 and 25 to a control box 26 so that the illustrated supply of three-phase 440 VAC can be connected thereto in the usual manner. The control box is of conventional design and includes the usual pilot circuit for automatically starting or stopping the motor by manually actuating a switch 26′.

A circuit containing box 27 has a circuitry housed therein, which is made in accordance with the present invention. The circuitry is connected to the power source by means of electrical conductors 28 and 29, while electrical conductors 30 and 31 are connected to the beforementioned controller 26 to thereby enable starting and stopping of the motor 22 to be controlled, as will be more fully discussed later on in this disclosure.

Figure 2:
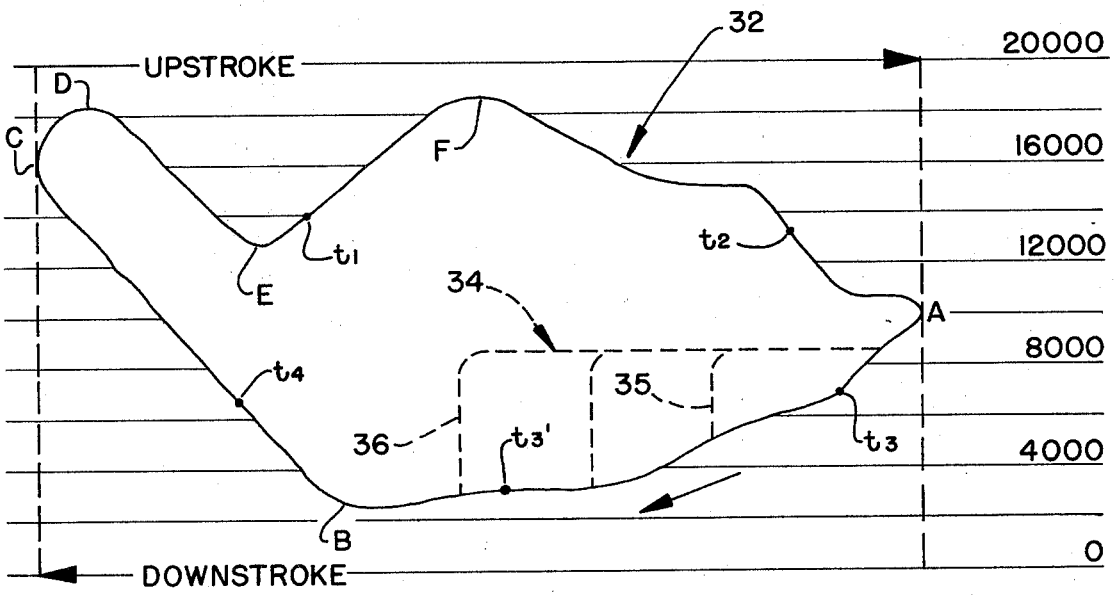
FIG. 2 is a diagrammatical illustration of a curve which has been drawn with a dynamometer.

FIG. 2 is a curve which illustrates a dynamometer trace 32, and describes the rod tension which occurs therewithin each pumping cycle, with the downstroke occurring along the X axis, as indicated by the portion of the curve at ABC, while the upstroke is indicated at DEFA. The portion of the curve near A indicates normal pump action during the transition from the upstroke to the downstroke, while the curve portion near C indicates pump action during the transition from the downstroke to the upstroke. The dot-dash portion 34 of the curve indicates a pump-off condition which grows in severity or magnitude from 35 to 36, and which requires a progressively greater time interval from A to 36, as compared to the time interval of curve 35. Letters $t_1$ through $t_4$ indicate lapsed time.

Figure 3:
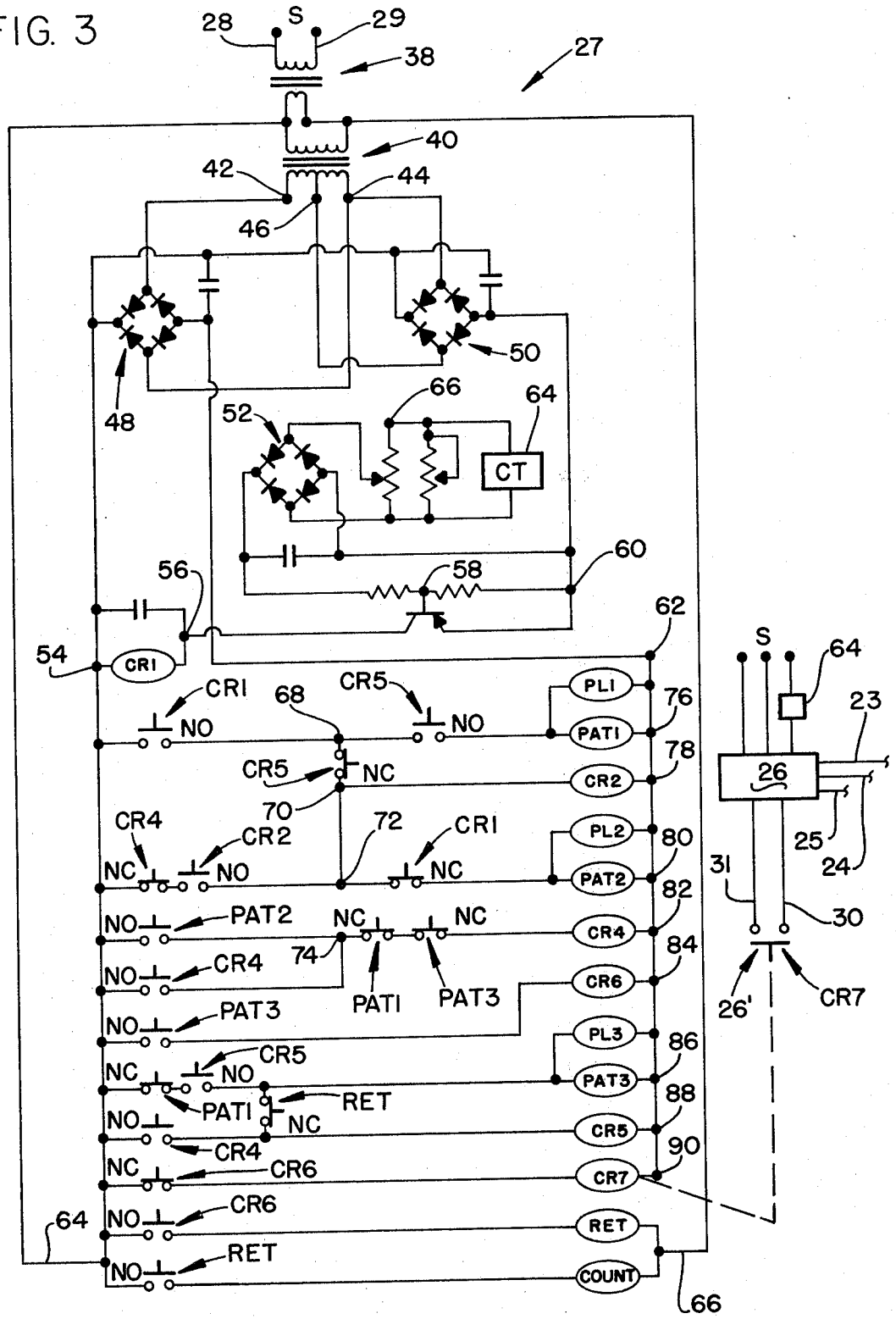
FIG. 3 schematically illustrates part of the circuitry broadly illustrated in FIG. 1.
Figure 4:
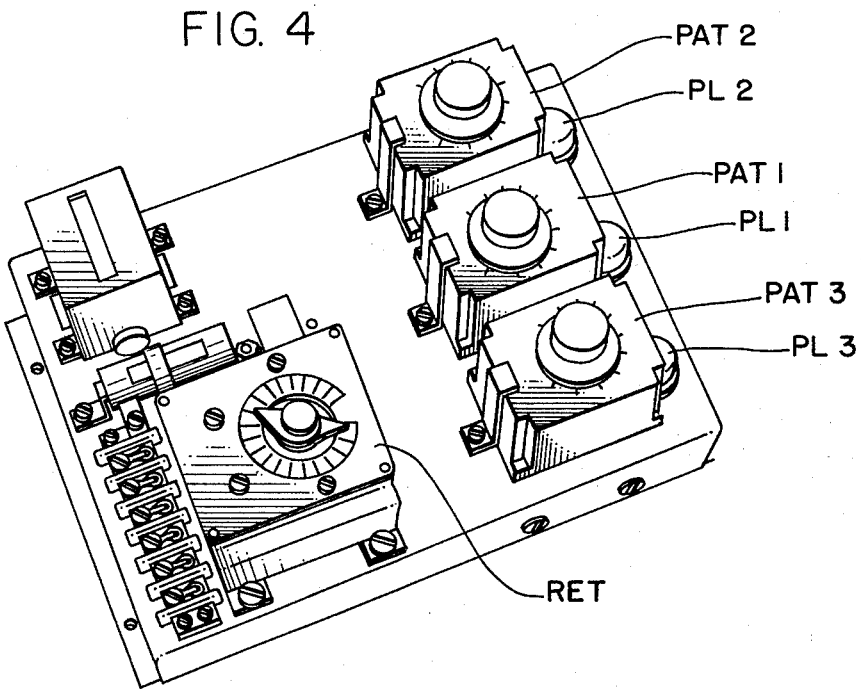
FIG. 4 is a perspective top view of one form of the control apparatus disclosed in FIGS. 1 and 3; and, FIG. 5 discloses part of the circuitry of FIG. 3 in a different operative configuration.

In FIGS. 3 and 4, the beforementioned circuitry 27 is seen to include a stepdown transformer 38 connected to leads 28 and 29 to thereby provide a 110-volt source for the primary of transformer 40. Transformer 40 is also a stepdown transformer which provides 24 volts at 42 and 44, and 16 volts between terminals 41 and 44.

As seen in FIG. 3, rectifiers 48 and 50 are connected to transformer 40, while rectifier 52 is connected to the trigger circuitry in the illustrated manner of FIG. 3. The rectifiers 48 and 50 provide suitable operating voltages between terminals 54, 56, 58, 60, and 62 which coincide with the voltage requirements of the various indicated remaining circuit components.

The illustrated current transformer 64 is connected into one of the three-phase electrical conductors 23–25 through which current must flow to the pumpjack motor. Resistors connected across the current transformer at junction 66 control the output of rectifier 52, which also provides a trigger current for the illustrated transistor connected to junction 58, thereby controlling current flow to junction 56 and to the illustrated parallel connected capacitor and control relay CR1 connected across junctions 54 and 56.

Rectifier 48 is connected to supply current between junctions 54 and 62, with the illustrated parallel and series connected control devices being connected thereacross in the illustrated manner of FIG. 3, so as to provide one embodiment which accomplishes the purpose of the present invention.

Throughout the remainder of this disclosure, the abbreviation CR means "control relay", PAT means "pacing timer", PL means "pilot light", RET means "rest timer", NC means "normally closed switch contacts", and NO means "normally open switch contacts".

CR1 is connected to actuate the NO and NC CR1 seen in legs 76 and 80. PL1 is connected in parallel respective to PAT1, which is connected in leg 76, and actuates the two NC PAT1 located in legs 82 and 86 to the open position when energized. CR2 of leg 78 actuates NO CR2 of leg 80, while PL2 is connected in parallel across PAT2 in leg 80, and which actuates the NO PAT2 of leg 82. CR4 is connected to the three illustrated CR4 switches of legs 80, junction 74, and leg 88; the uppermost of which is NC and the second as well as the lowermost of which is NO. CR6 is located in leg 84 and actuates the NO and NC CR6 of legs 66 and 90, respectively; while PL3 is parallel connected respective to PAT3 in leg 86. The last named pacing timer actuates the two illustrated NO and NC associated with legs 82 and 84. CR5, when actuated, moves the NO CR5 of legs 86 and 76 to the closed position, while the NC CR5 across junctions 68 and 70 is moved to the open position. CR7 is connected back into the pilot portion of controller 26 at 26′ so that the controller 26 can be remotely actuated into the de-energized configuration, thereby disconnecting motor 22 from its source of current. This action "shuts in" the well.

RET is connected to the NC and NO RET found across legs 86 and 88, and in leg 66; while the counter is connected across the 110-volt supply at junction 64 and 66.

Figure 5:
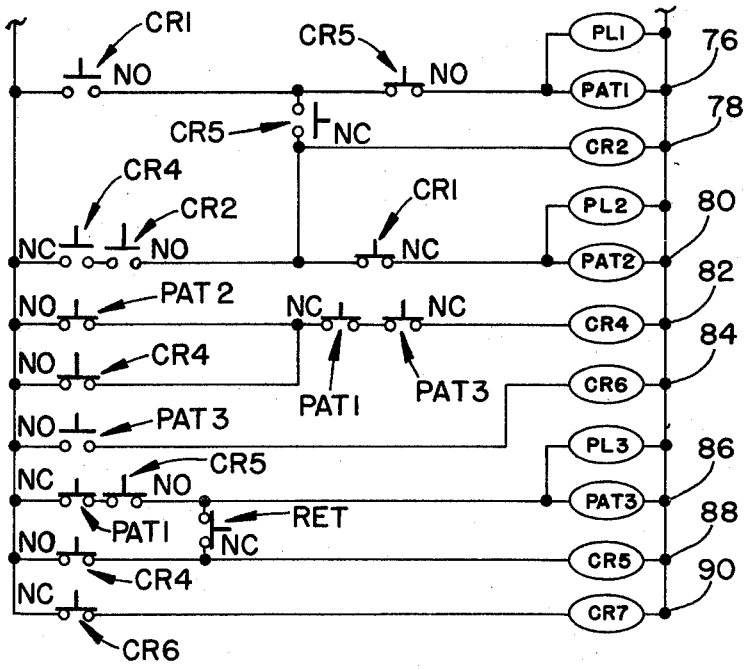

The following data more specifically points out and describes the details of the various circuit components described in FIG. 3. FIG. 5 is identical to FIG. 3, and therefore, the details thereof need no further illumination beyond the above discussion of FIG. 3. The operative difference in FIGS. 3 and 5 will be fully discussed later on in this disclosure.

| PARTS LIST OF ALL RELAYS AND TIMERS | |
|---|---|
| PAT1 | Potter-Brumfield Cat. No. CDD-38-30003 0.1 to 10 second time delay timer |
| PAT2 | Potter-Brumfield Cat. No. CDD-38-30003 0.1 to 10 second time delay timer |
| PAT3 | Potter-Brumfield Cat. No. CHD-38-30003 0 to 180 second time delay timer |
| RET | Industrial Timer Corp. Model J4974 0–5 Min. timer |
| Counter | General Controls Co. Cat. No. CE60AN602 counter |
| CR1 | Potter-Brumfield Cat. No. R50-E2-Y2 12 volt relay |
| CR2, CR4, CR5, CR6 | Potter-Brumfield Cat. No. R50-E2-Y2 24 volt relay |
| CR7 | Potter-Brumfield Cat. No. KA14DG 24 volt relay |
| CT | General Electric Cat. No. 750X91G5 100/5 amp current transformer |
| PL1, PL2, PL3 | Drake Cat. No. 5100-822-703 Pilot lights |
| RE1 | International Resistor Co. Cat. No. 2 DA 10 ohm 25 watt resistor |
| RE2 | Mallory Cat. No. MR100F 100 ohm 3 watt resistor |
| CA1, CA2, CA3, CA4 | Sprague Cat. No. TVA 1203 5 MFD 50 volt capacitor |
| TR40 | Nutone Cat. No. 320A 120/8-16-24 volt transformer |
| RECI | Sylvania Cat. No. ECG 169 rectifier |
| REC2, REC3 | Mallory Cat. No. FW 100 rectifier |
| R1 | International Resistor Co. Cat. No. 1000 ohm ½ watt resistor |
| R2 | International Resistor Co. 2700 ohm ½ watt resistor |
| T1 | Sylvania Cat. No. ECG 128 Transistor |

OPERATION

In operation, with the well pumping under acceptable production conditions, the current load on the motor will increase and then decrease on each upstroke and downstroke of the rod string. This cyclic operation of the well apparatus follows the dynamometer trace of FIG. 2, wherein A represents the end of the upstroke and the beginning of the downstroke. As the string commences to move downhole, the fluid load is transferred from the sucker rod string to the tubing as the traveling valve in the pump moves to the opened position at the beginning of the downstroke, assuming the apparent volumetric efficiency of the well is of a reasonable value.

Portion B of the curve of FIG. 2 represents the minimum load, which is also the lowest point of the curve on the dynamometer card, and occurs slightly past the center of the downstroke. From B to C the rod is moving in a downward direction while the rod load is increasing. When the rod motion is considered, it is seen that its speed on the downstroke accelerates until it reaches a maximum velocity near the center of the downstroke, whereupon the rod then decelerates until it comes to an instantaneous stop at the end of the downstroke. As the rod string reverses its direction at point C, it acts as a spring and further elongates. Hence the polish rod is subjected to an increasing load which reaches its peak at point D.

From point D to point E the elastic properties of the sucker rod string gives back some of the energy, which was stored up when the rod string was stretched at the end of the downstroke. From point D to E the rod string moves uphole at an increasing speed; thereby moving the sucker rod string as well as the weight of the fluid. The energy given back to the system by the spring action of the rod string causes a decreasing load between these points.

The curve from E to F represents a continuation of the upstroke, and the load is seen to be increasing as the fluid and sucker rod string are moved at an increasing velocity. Point F represents the maximum load, and is attained at approximate center of the upstroke.

From point F to point A the polish rod is decelerating. This action accounts for the decreasing load at this part of the upstroke. The well production characteristics continue in this manner until a pump-off condition is encountered at 34, whereupon the curve characteristics change as suggested at 35 and 36.

Hence it is apparent that there is no appreciable load on the motor during the transition from the upstroke to the downstroke at A, as well as from the downstroke to the upstroke at C for each cycle of pump operation. When the well encounters a pump-off condition, and since the magnitude or severity of the pump-off condition is also a measure of the fluid level respective to the downhole pump inlet, it follows that the current load will progressively be off the motor during the time shape change along line 34. This change in downhole reservoir conditions extends the end of the no load time interval from $t_3$ to $t_3'$ for example, and indicates that a pump-off condition has been encountered. On the other hand, the time interval along the curve BCDEFA always remains constant.

As the sucker rod tension increases, the current flow through the prime mover also increases, and the current transformer loads up the two resistors connected to junction 66, so that any desired current threshold value can be controllably produced from rectifier 52 for triggering the transistor located at junction 58. Accordingly, the selected magnitude of increased current flow through the current transformer provides a suitable current flow at junction 56 for actuating CR1. Proper adjustment of the resistors will screen out extraneous background current or interference.

Energization of CR1 closes the NO CR1 in leg 76 and opens the NC CR1 in leg 80; thereby providing current flow at junctions 68 and 70, and hence to CR2. Energization of CR2 provides a current flow path across the NO CR2 to junction 72. CR2 is now held energized through NC CR4 and NO CR2 of leg 80.

PAT2 is therefore reset each time the current load builds up at 56 to energize solenoid CR1, which moves CR1 NC to the open position. When the current load goes off, CR1 NC moves to the closed position and PAT2 starts timing out while PL2 is lighted, and if CR1 fails to be energized in time to reset PAT2, it times out; whereupon NO PAT2 in leg 82 is moved to the closed position. The last named switch provides current through the two illustrated NC PAT1 and PAT3, and to the CR4; thereby causing the three illustrated NO and CR4 to be moved to the alternate position. The circuitry will now attain the configuration seen illustrated in FIG. 5, wherein upper NC CR4 has moved into the open position and de-energizes CR2, while CR5 is energized and opens NC CR5 at junction 70, and closes NO CR5 in leg 76. Now CR1 is pulsing PAT1, rather than PAT2, by means of CR1 NO.

Moreover, increased motor current commencing at $t_3'$ of FIG. 2 now causes PAT1 to be pulsed, whereas heretofore, decreased motor current commencing at $t_2$ pulsed PAT2.

At the same time, energization of CR4 causes closure of the lowermost NO CR4, which provides CR5 of leg 88 with current; thereby moving NO CR5 at 76 and 86 to the closed position, and opening NC CR5 at junctions 68–70, thereby providing two different current flow paths for either of CR5 and PAT3. Energization of PAT3 causes it to commence the time out, while PL3 is illuminated. If PAT3 times out, NC PAT3 is moved to the open position, while NO PAT3 will be moved to the closed position. This action of the circuitry simultaneously energizes CR6 and CR7, and de-energizes CR4 which causes NC CR4 and the two NO CR4 to assume their normal configuration.

Energization of relay CR6 moves NC CR6 to the open position, while the NO CR6 is moved to the closed position. This action moves NO CR7 to the open position; thereby causing the pilot control circuit portion of controller 26 to de-energize the motor, while at the same time, the RET moves the illustrated NO and NC RET to the alternate position. When NC RET is moved to the open position, current flow to PAT3 is interrupted, thereby causing its associate switch contacts to assume their normal configuration.

When NO RET is moved to the closed position, the counter is actuated, thereby storing data which signifies that another production cycle of the pumpjack has expired. The RET can be set to shut in the well for any length of time, as for example, 55 minutes. After the time has run out on RET, the motor will restart, according to the following sequence of events:

When the rest timer times out, it opens RET NC and closes RET NO. This action de-energizes CR5, which moves CR5 NO to the opened position, thereby de-energizing PAT3, whereupon CR6 is de-energized because of PAT1, 2, and 3 opening the NC contacts thereof, which energizes CR7 and starts the well again. Hence the sequence of operation commences all over again.

Upon restart of the pumpjack unit, the gas remaining in the pump from the last shutdown will induce fluid pounding for the first several sequential pump strokes. Therefore, provisions must be made to prevent these several consecutive fluid pounding strokes from shutting in the well. This expedient is accomplished by the circuitry as follows:

CR1 is energized, which closes CR1 NO to provide a current flow path to CR2, which forms a current flow path for PAT2, as in the before described manner. Since the gas remaining in the well causes fluid pounding upon start-up, immediate control is initiated over CR5 and PAT2, 3, and 1. PAT1 times out and de-energizes CR4 at NC PAT1, and during the next few strokes, more time during the load period is progressively encountered on the downstroke as the gas is expelled from the pump barrel, thereby causing the apparatus to reset back to the normal load condition.

Therefore, the present invention provides circuitry which is responsive to cyclic current flow of a predetermined varying magnitude and sequence for a predetermined time interval, which determines the action of the controller over the motor. This cyclic flow of current at 56 energizes control relay 1, which indirectly provides a circuit to the pacing timer 2. The pacing timer 2 is a load timer, and as the rod load increases, the current flow through the current transformer increases, and CR1 NC opens while CR1 NO closes, thereby resetting the pacing timer 2 each pumping cycle if it has not timed out. As soon as the rod load goes off, the pacing timer 2 starts its timing duties, while PL2 is illuminated to indicate that PAT2 is in the act of timing out.

If PAT2 times out before it is again reset by CR1 NC, a longer no load time period than normally required at A of FIG. 2 has been sensed, and the well has pumped off because the time interval between the load reduction on the motor at the end of the upstroke load and the beginning of the downstroke load has become greater than would ordinarily be realized in the absence of fluid pounding, and $t_3$ has moved along the curve of FIG. 2 toward $t_3'$. Therefore, when the well pumps off, PAT2 times out before being reset by CR1 NC. Accordingly, PAT2 initiates control by closing the NO PAT 2 through current flow path described by PAT1 NC, PAT3 NC, and CR4. CR4 is locked in by CR4 NO and stays energized, unless the NC PAT1 or 3 are opened. Energization of CR4 closes CR4 NO, thereby energizing CR5, which energizes PAT1. PAT3 is the pacing timer for the preselected number of strokes it is desired to pace the well before shut in. The well can be paced for any number of strokes, for example, 10.

EXAMPLE

When the well is pumping properly, FIG. 2 shows that the load is on the motor $t1$–$t2$ and $t3$–$t4$. There is reduced load on the motor $t2$–$t3$ and $t4$–$t1$.

When the well is pumped off, the load is on the motor $t1$–$t2$ and $t3'$–$t4$. There is reduced load on the motor $t2$–$t3'$ and $t4$–$t1$.

Assuming 4 sec/cycle, or 2 seconds for upstroke or downstroke, $t1$–$t2$ requires 1.11 second, $t2$–$t3$ requires 0.48 second, $t3$–$t4$ requires 1.35 second, and $t4$–$t1$ requires 1.06 second.

When the well is pumped off, $t1$–$t2$ remains at 1.11 second; $t2$–$t3'$ requires 1.16 second; $t3'$–$t4$ requires 0.67 second; $t4$–$t1$ requires 1.06 second.

In this instance, PAT1 is set to operate at 1.15 second, PAT 2 at 1.11 second, and PAT3 at 20 seconds, or ten consecutive strokes. Therefore, if PAT2 fails to be reset by CR1 within 1.11 second, an abnormal no load time interval is present and the contacts thereof are moved to the alternate position; whereupon, the above events commence to shut in the well. Should 10 consecutive strokes elapse under this $t2$–$t3'$ time condition, the well will be shut in for a rest period determined by the selected time for RET, as for example 55 minutes. After RET times out, the well is restarted as explained above.

I claim:

1. In a prime mover subjected to a cyclic load normally varying between substantially repeated maximum and minimum values on successive cycles of operation and wherein the time intervals of a maximum and minimum load value changes appreciably upon loss of load, the combination with said prime mover of a pumpoff control device for de-energizing said prime mover upon significant reduction in load thereon;

said device having means generating a signal related to the time interval of said maximum and minimum load value;

a first pacing timer means having switch contacts associated therewith which are actuated following a first time delay interval upon pacing timer being actuated;

a second pacing timer means having switch contacts associated therewith which are actuated following a second time delay interval upon said second pacing timer being actuated;

said first and second time delay interval being greater in time duration respective to the time interval of the minimum load, said first time delay interval being greater than said second time delay interval;

circuit means by which said signal actuates said second pacing timer means coincident with occurrence of a minimum load time interval;

means, including circuitry, by which the contacts of said first pacing timer are connected to de-energize the prime mover when the contacts are actuated;

means, including circuitry, by which actuation of the contacts of said second pacing timer are connected to establish a current flow path to said first pacing timer; circuit means by which said signal actuates said first pacing timer means coincident with the occurrence of a maximum load signal;

said prime mover being an electric motor; means, including a current transformer, connected to measure the current flow to the electric motor to provide said means generating a signal;

whereby said second pacing timer is reset by said signal each cycle of operation only when the duration of the signal is of a smaller time duration than said second time delay interval, and said first pacing timer continues energization of the prime mover only when said time interval of said maximum load value is greater than said first time delay interval.

2. The combination of claim 1, and further including a third pacing timer means having switch contacts which are actuated after a third time delay upon said third pacing timer being energized;

the last said switch contacts being actuated in response to actuation of the switch contacts of said first pacing timer means;

means including circuitry by which the contacts of said third pacing timer delays the de-energization of the prime mover until a plurality of successive reduced load time intervals have transpired;

a rest timer means and circuitry, by which the prime mover is again energized after a rest period of sufficient time duration to enable the cause of the reduced load to be obviated.

3. The combination of claim 1 and further including a third pacing timer means having switch contacts which are actuated after a third time delay upon said third pacing timer being energized;

the last said switch contacts being actuated in response to actuation of the switch contacts of said first pacing timer means;

means including circuitry by which the contacts of said third pacing timer delays the de-energization of the prime mover until a plurality of successive reduced load time intervals have transpired.

4. The combination of claim 3 and further including a rest timer means and circuitry, by which the prime mover is again energized after a rest period of sufficient time duration to enable the cause of the reduced load to be obviated.

5. In a pumpjack apparatus having an electric motor connected to reciprocate a string of sucker rods which drive a downhole production pump, with the motor current cyclically varying between a maximum and minimum value each stroke of the rod string until a pump-off condition is encountered, whereupon the time interval of the one minimum current value increases, while the time interval of one maximum current value decreases;

the combination with said motor of a pump-off controller device for de-energizing the motor when the production pump encounters said pump-off condition;

said controller having means by which a signal is generated which is proportional to the time interval of said minimum and maximum current value;

a first, second, and third pacing timer means; said first pacing timer means having switch means which are actuated after a time delay interval which exceeds the time interval of the second pacing timer means and which is less than the time interval of the third pacing timer means;

means, including circuitry, by which said minimum current value signal causes said second pacing timer means to commence timing out;

means, including circuitry, by which actuation of the switch of the second pacing timer causes said first pacing timer to become responsive to said maximum current value, and to commence timing out concurrently with the time interval of said maximum current value;

means, including circuitry, by which actuation of the switch means of said first pacing timer means actuates said third pacing timer means;

circuit means by which said third pacing timer shuts in the well after a plurality of strokes; and means by which said first pacing timer prevents said third pacing timer from shutting in the well should said maximum signal indicate that the pump-off condition has been obviated.

6. The pump-off controller of claim 5, and further including a rest timer, including circuitry, by which the well is shut in for a time interval of several minutes to enable the pump-off condition to be obviated;

means responsive to rest timer for energizing said motor after said rest timer has timed out.

7. The combination of claim 6 wherein said prime mover is an electric motor; a current transformer connected to said motor, means by which said signal is generated in response to current flow through said transformer.

8. Method of controlling a pumpjack apparatus wherein the pumpjack has a string of sucker rods manipulated to reciprocate a downhole pump comprising:

1. measuring the tension of the sucker rod string while the pumpjack apparatus is producing the well to determine the time intervals of the increased and decreased rod loads each pumping cycle;

2. generating a signal having a time duration proportional to the time intervals of the increased and decreased rod loads;
3. actuating a time delay control means in response to the time interval of the decreased rod load increasing in time duration;
4. actuating another time delay control means in response to actuation of the first said control means and measuring the time interval of the increased rod load tension;
5. shutting in the well if the time interval of the increased rod load fails to increase from a small value indicative of a pump-off condition to a larger value indicative of the absence of a pump-off condition;
6. continuing the well production if the time interval of the increased rod tension increases from a value indicative of a pump-off condition to a value indicative of the absence of a pump-off condition;
7. restarting the well after a rest period which enables the fluid reservoir within the borehole to recover sufficiently to avoid a pump-off condition.

9. The method of claim 8 and further including the step of 8. measuring the tension of the sucker rod in step (1) by measuring the load on the prime mover each pump cycle and generating a signal proportional to the load;
9. using the last signal to actuate a solenoid-actuated switch whereby the switch contacts are actuated only during high current flow; and,
10. using the last named switch for producing said signal.

10. The method of claim 9 wherein said solenoid has a normal open and a normal closed switch, said normal closed switch being used for the low tension signal and said normal open switch being used for the high tension signal.

11. In a prime mover subjected to a cyclic load normally varying between substantially repeated maximum and minimum values on successive cycles of operation and wherein the time intervals of a maximum and minimum load value changes appreciably upon loss of load, the combination with said prime mover of a pumpoff control device for de-energizing said prime mover upon significant reduction in load thereon;

said device having means generating a signal related to the time interval of said maximum and minimum load value;

a first pacing timer means having switch contacts associated therewith which are actuated following a first time delay interval upon said pacing timer being actuated;

a second pacing timer means having switch contacts associated therewith which are actuated following a second time delay interval upon said second pacing timer being actuated;

said first and second time delay interval being greater in time duration respective to the time interval of the minimum load, said first time delay interval being greater than said second time delay interval;

circuit means by which said signal actuates said second pacing timer means coincident with occurrence of a minimum load time interval;

means, including circuitry, by which the contacts of said first pacing timer are connected to de-energize the prime mover when the contacts are actuated;

means, including circuitry, by which actuation of the contacts of said second pacing timer are connected to establish a current flow path to said first pacing timer; circuit means by which said signal actuates said first pacing timer means coincident with the occurrence of a maximum load signal;

whereby said second pacing timer is reset by said signal each cycle of operation only when the duration of the signal is of a smaller time duration than said second time delay interval, and said first pacing timer continues energization of the prime mover only when said time interval of said maximum load value is greater than said first time delay interval;

and further including a third pacing timer means having switch contacts which are actuated after a third time delay upon said third pacing timer being energized;

the last said switch contacts being actuated in response to actuation of the switch contacts of said first pacing timer means;

means including circuitry by which the contacts of said third pacing timer delays the de-energization of the prime mover until a plurality of successive reduced load time intervals have transpired;

a rest timer means and circuitry, by which the prime mover is again energized after a rest period of sufficient time duration to enable the cause of the reduced load to be obviated.

* * * * *

UNITED STATES PATENT OFFICE

CERTIFICATE OF CORRECTION

PATENT NO. : 3,998,568

DATED : December 21, 1976

INVENTOR(S) : IKE W. HYND

It is certified that error appears in the above-identified patent and that said Letters Patent are hereby corrected as shown below:

Column 6, line 44, delete "shape".

Column 7, line 8, after "and", insert --NC--;

line 11, after "has", insert --been--;

line 26, substitute --to-- for "the".

Column 9, line 14, after "upon", insert --said--.

Signed and Sealed this

Tenth Day of May 1977

[SEAL]

*Attest:*

RUTH C. MASON
*Attesting Officer*

C. MARSHALL DANN
*Commissioner of Patents and Trademarks*